US011578517B2

(12) United States Patent
Martin et al.

(10) Patent No.: US 11,578,517 B2
(45) Date of Patent: Feb. 14, 2023

(54) SYSTEMS AND METHODS FOR IMPROVING WINDOW SAFETY

(71) Applicant: Lansing Housing Products, Inc., Lansing, IA (US)

(72) Inventors: Kevin Martin, Waukon, IA (US); Brian Houlihan, Harpers Ferry, IA (US)

(73) Assignee: Lansing Housing Products, Inc., Lansing, IA (US)

( * ) Notice: Subject to any disclaimer, the term of this patent is extended or adjusted under 35 U.S.C. 154(b) by 344 days.

(21) Appl. No.: 16/889,464

(22) Filed: Jun. 1, 2020

(65) Prior Publication Data

US 2021/0372176 A1 Dec. 2, 2021

(51) Int. Cl.

| | |
|---|---|
| ***E05C 17/36*** | (2006.01) |
| ***E06B 9/01*** | (2006.01) |
| ***E06B 9/52*** | (2006.01) |
| *E06B 9/00* | (2006.01) |

(52) U.S. Cl.

CPC ..... *E05C 17/36* (2013.01); *E06B 9/01* (2013.01); *E06B 9/52* (2013.01); *E05Y 2900/144* (2013.01); *E06B 2009/002* (2013.01); *E06B 2009/015* (2013.01); *E06B 2009/527* (2013.01)

(58) Field of Classification Search

USPC ..... 292/262

See application file for complete search history.

(56) References Cited

U.S. PATENT DOCUMENTS 1,977,165 A * 10/1934 Williams ..... E06B 9/52 160/369
2,221,005 A * 11/1940 Reese ..... E06B 3/9688 52/204.593
2,266,235 A * 12/1941 Mollard ..... E06B 3/28 52/211
2,975,491 A * 3/1961 Paul ..... E06B 3/28 206/820
3,214,879 A * 11/1965 Ellingson, Jr. ..... E06B 3/28 49/490.1

(Continued)

OTHER PUBLICATIONS

Cincinnati Children's Hospital Medical Center, "Window Fall Prevention", www.cincinnatichildrens.org/health/w/window-falls (Jul. 2015).

(Continued)

*Primary Examiner* — Joshua K Ihezie

(74) *Attorney, Agent, or Firm* — McCarter & English, LLP; Kia L. Freeman; Thomas F. Foley

(57) ABSTRACT

A system for improved window fall prevention provides removable attachment of a window screen frame to a window frame. Systems according to the disclosure provide removable attachment of a window screen frame to an anchor positioned in the window frame by means of a plurality of cables. The cables attach to the screen frame or rest against an exterior portion of the screen frame at an exterior end, are threaded through the screen frame, and include on an interior end, opposite the exterior end, a releasable attachment to the window frame anchor. The releasable attachment may be between a loop of cable formed at the interior end and the window frame anchor, where the window frame anchor may be a T-screw.

17 Claims, 9 Drawing Sheets

(56) References Cited

U.S. PATENT DOCUMENTS 3,779,175 A * 12/1973 Wallen, Sr. ..... B61D 17/04 105/353
3,804,454 A * 4/1974 Simmons ..... E05C 17/365 24/298
3,836,187 A * 9/1974 Buettner ..... E05C 7/00 292/264
4,044,813 A * 8/1977 Emmons ..... E06B 9/52 160/354
4,186,912 A * 2/1980 Byrd, Jr. ..... E01F 7/00 116/63 P
4,210,191 A * 7/1980 Li ..... E06B 3/285 160/354
4,288,119 A * 9/1981 Geiger ..... E05C 17/36 292/262
4,304,082 A * 12/1981 Peters ..... E04B 1/94 428/920
4,409,758 A * 10/1983 Dickerson ..... E06B 3/28 160/369
5,134,806 A * 8/1992 Burkart, Jr. ..... E06B 9/02 49/55
5,358,025 A * 10/1994 Wood ..... E06B 9/521 160/368.1
6,209,598 B1 * 4/2001 Petrey ..... G09F 7/002 160/368.1
6,263,625 B1 * 7/2001 LaPointe ..... E06B 9/02 52/509
6,325,085 B1 * 12/2001 Gower ..... E04H 9/14 135/90
6,334,455 B1 * 1/2002 Nunez, Sr. ..... E04H 15/322 135/120.3
6,634,146 B2 * 10/2003 Carlson ..... E04F 21/0015 52/214
6,658,801 B2 * 12/2003 Kilduff ..... A62C 2/10 160/354
7,654,045 B2 * 2/2010 Wiegel ..... E06B 9/06 52/63
7,841,378 B2 * 11/2010 Henning ..... E01F 7/025 160/368.1
7,842,116 B2 * 11/2010 Simmons ..... B01D 46/0005 55/480
7,946,333 B1 * 5/2011 Zapata ..... E06B 9/521 160/354
8,037,923 B2 * 10/2011 Alkhoury ..... E06B 9/52 160/369
8,171,681 B2 * 5/2012 Miller ..... E06B 9/02 52/2.14
8,251,121 B1 * 8/2012 Casey ..... E04F 10/02 160/368.1
8,372,508 B2 * 2/2013 Reuter ..... E06B 3/285 52/746.1
8,528,279 B1 * 9/2013 Greene, Jr. ..... E06B 9/01 49/55
8,572,911 B1 * 11/2013 Binienda ..... E06B 9/00 52/2.16
8,943,755 B2 * 2/2015 Herlihy ..... F24F 13/24 62/262
9,617,784 B2 4/2017 Houlihan
9,863,105 B1 * 1/2018 Price ..... E01F 13/12
10,995,546 B2 * 5/2021 Seuberling ..... E06B 9/52
2002/0073933 A1 * 6/2002 Oakman ..... A01K 15/023 119/721
2002/0098920 A1 * 7/2002 Bruyer ..... A63B 71/022 473/421
2002/0134414 A1 * 9/2002 Gower ..... E04H 9/14 135/90
2003/0075385 A1 * 4/2003 Walls ..... E04G 21/3261 182/138
2003/0140593 A1 * 7/2003 Trundle ..... E06B 5/12 52/202
2004/0006937 A1 * 1/2004 Jones ..... E06B 9/00 405/52
2004/0154242 A1 * 8/2004 Hudoba ..... F16B 43/00 52/202
2005/0091923 A1 * 5/2005 Pleasants ..... E06B 9/02 49/57
2005/0246978 A1 * 11/2005 Johnson ..... F16G 11/12 52/201
2007/0107327 A1 * 5/2007 Warner ..... E06B 9/02 49/463
2007/0193137 A1 * 8/2007 DeBoth ..... E06B 9/02 52/202
2008/0086960 A1 * 4/2008 Emek ..... E06B 5/12 52/745.18
2009/0183844 A1 * 7/2009 Alkhoury ..... E06B 9/52 160/369
2010/0083585 A1 * 4/2010 Miller ..... E06B 9/02 52/202
2015/0211247 A1 * 7/2015 Gembala ..... E04G 21/3266 182/138
2016/0201387 A1 * 7/2016 Allen ..... E06B 9/01 160/327

OTHER PUBLICATIONS

U.S. Consumer Product Safety Commission, "Window Falls Prompts CPSC to Issue Warning", Release No. 08-270 (May 15, 2008).
Vaughn A. Harris, et al., "Pediatric Injuries Attributable to Falls from Windows in the United States in 1990-2008", Pediatrics, 128:3 (Sep. 2011).
ASTM International, "Standard Specification for Window Fall Prevention Devices with Emergency Escape (Egress) Release Mechanisms", Designation: F2090-17 (Nov. 2017).

* cited by examiner

SYSTEMS AND METHODS FOR IMPROVING WINDOW SAFETY

BACKGROUND

It is estimated that 15 to 20 children under 11 die in falls from windows each year in the United States, and nearly 15,000 are injured. Cincinnati Children's Hospital Medical Center, "Window Fall Prevention", (July 2015) available at https://www.cincinnatichildrens.org/health/w/window-falls. In 2008, the U.S. Consumer Product Safety Commission (CPSC) reported from 2002-2004 it received an average of 25 reports a year of fatalities associated with falls from windows, with children younger than five accounting for approximately one-third. CPSC Release No. 08-270 (May 15, 2008). A 2011 study found that an estimated 98,415 children were treated in U.S. hospital emergency departments for falls from windows from 1990-2008, an average of 5,180 annually. Of the 98,415 falls, in at least 16,235 a window screen was reportedly in place in the window. Vaughn A. Harris, et al., "Pediatric Injuries Attributable to Falls from Windows in the United States in 1990-2008," *Pediatrics,* 128:3, 455 (September 2011).

ASTM International has adopted a Standard Specification for Window Fall Prevention Devices with Emergency Escape (Egress) Release Mechanisms, Designation: F2090. The current edition, designated ASTM F2090-17, was approved in November 2017. According to ASTM F2090-17, "[t]he CPSC has advised caregivers to open windows less than 4 inches when children are present as one means to prevent child falls through open windows."

A variety of window opening control devices have been developed to limit window opening to less than 4 inches. Window opening control devices are the standard protection against child falls through a window. Window opening control devices must withstand a 75 lbf load in the opening direction of the window sash. Window opening control device are conventionally designed with a release mechanism for emergency escape or rescue. Despite the protection offered by the devices, people are known to release, remove, and/or disable window opening control devices so that they can open the window 4.0 inches or more, for example, for greater ventilation. Increased ventilation is often desired for greater personal comfort. Increased ventilation may be especially desirable in hot weather and where air conditioning is not available. The Centers for Disease Control have recommended increased ventilation in residential, commercial, and workplace environments to reduce spread of infections, including the coronavirus.

Conventional window screens are insufficient to protect against child falls through open windows. Indeed, of the 98,415 falls between 1990-2008 identified in the 2011 study, a conventional window screen was reportedly in the window in at least 16,235 of the falls, which corresponds to 82.8% of the falls for which information regarding presence or absence of a screen was reported. Vaughn A. Harris, et al., "Pediatric Injuries Attributable to Falls from Windows in the United States in 1990-2008," *Pediatrics,* 128:3, 455 (September 2011).

Fall prevention window guards are known and sometimes installed to prevent a child from passing or falling through a window that is open more than 4.0 inches. Fall prevention window guards typically attach to a window frame or window extension jamb and provide a plurality of elements that serve only to prevent a child from passing through the window opening. Fall prevention window guards can be expensive and people may not bother to install them. In particular, people may not enjoy looking through fall prevention window guards in their windows and may fail to install or may remove the guards.

In U.S. Pat. No. 9,617,784, the inventor disclosed a safety screen that in addition to providing the standard benefits of a window screen also provides some protection from child falls out of a window. The '784 patent is hereby incorporated by reference in its entirety. The inventor recognized that improper installation of a safety screen in accordance with the '784 patent may compromise the safety offered by the safety screen. The inventor further recognized that a safety screen in accordance with the '784 patent alone may not satisfy all of the performance criteria of ASTM F2090-17. Accordingly, the inventor recognized a need for one or more additional safety devices for use with a window and a safety screen, to provide further protection against child falls through a window with a safety screen.

SUMMARY

A system for improved window fall prevention provides removable attachment of a safety screen frame to a window frame. In embodiments, the system provides removable attachment of a safety screen frame to an anchor positioned in the window frame by means of a plurality of cables. The cables attach to the screen frame or rest against an exterior portion of the screen frame at an exterior end, are threaded through the screen frame, and include on an interior end, opposite the exterior end, a releasable attachment to the window frame anchor. In embodiments, the releasable attachment is between a loop of cable formed at the interior end and the window frame anchor, which the window frame anchor may be a T-screw. The releasable attachment may be releasable without the use of tools.

Embodiments of the present technology provide a number of advantages, such as ensuring that a child may not fall through a window even if the window is open and the screen is disconnected from the window. Further, although other safety systems may rely upon the screen remaining in place on the window frame, with the present system, even if the screen becomes loose, falls through the window may still be prevented by the present technology. Accordingly, the present system may provide a margin of safety even if a screen was installed incorrectly. The present technology may also permit removal of the device for emergency egress or to remove the screen for screen repair and service. Embodiments may allow a screen to give when receiving force while still limiting any gap between the screen frame and the window frame to a safe size.

Additionally, unlike window opening control devices that limit a sash opening of the window and thereby limit the ventilation available through the window, the present technology provides protection without limiting the ventilation available through the window. This advantage also reduces the likelihood that people would release, remove, and/or disable the device in order to improve ventilation, as may occur with window opening control devices. Embodiments may be installed as an after-market addition to existing and/or installed safety screens. The present technology may also provide a deterrent to intruders in that the screen will remain attached to the window frame by the plurality of cable systems even if an intruder removes the screen from the window frame, thereby delaying or frustrating the intruder.

Other features and advantages of the present invention will become apparent from the following description of the invention which refers to the accompanying drawings.

DETAILED DESCRIPTION

Reference will now be made in detail to certain exemplary embodiments according to the present disclosure, certain examples of which are illustrated in the accompanying drawings. Wherever possible, the same reference numbers will be used throughout the drawings to refer to the same or like parts. It may be understood that both the foregoing general description and the following detailed description are exemplary and explanatory only and are not restrictive of the invention, as claimed. It is understood that other embodiments may be utilized and that structural changes may be made without departing from the scope and spirit of the invention.

In this application, the use of the singular includes the plural unless specifically stated otherwise. In this application, the use of "or" means "and/or" unless stated otherwise. Furthermore, the use of the term "including", as well as other forms, such as "includes" and "included", is not limiting. Any range described herein will be understood to include the endpoints and all values between the endpoints. All documents, or portions of documents, cited in this application, including but not limited to patents, patent applications, articles, books, and treatises, are hereby expressly incorporated by reference in their entirety for any purpose.

Figure 2:
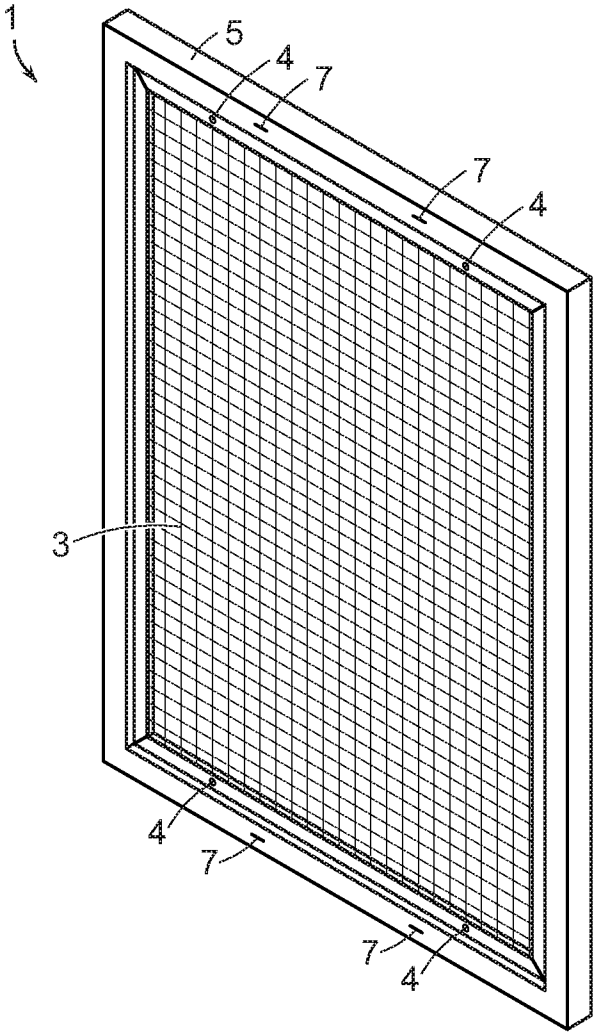
FIG. 2 is a prospective view of a screen mounted in a window frame.
Figure 1:
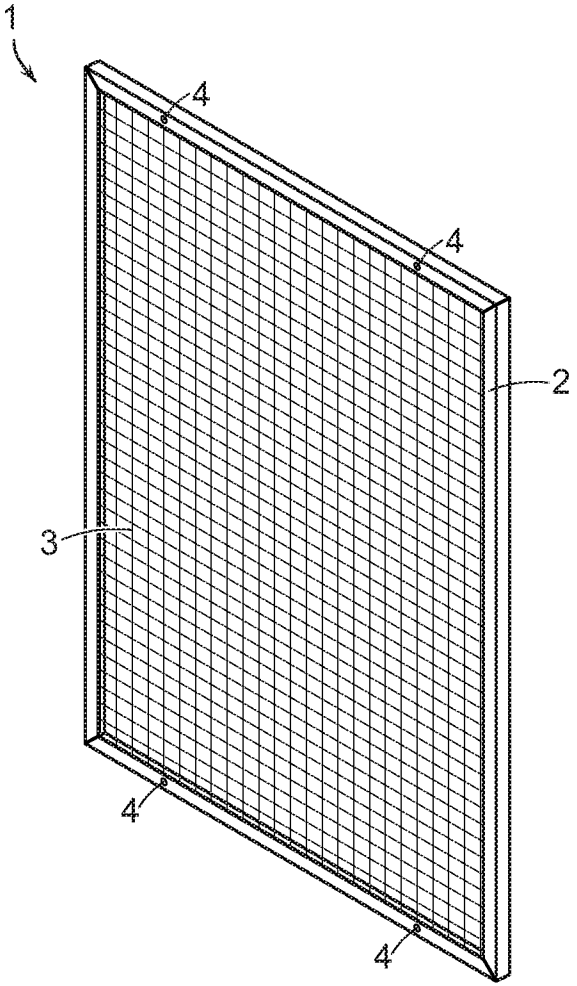
FIG. 1 is a prospective view of a screen.
Figure 4A:
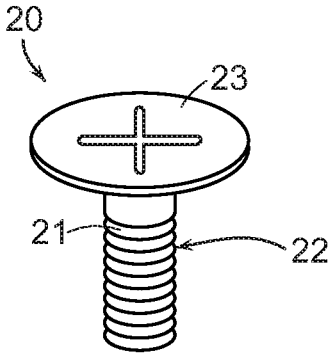
FIG. 4A is a front view of an anchor with a rounded head.
Figure 4B:
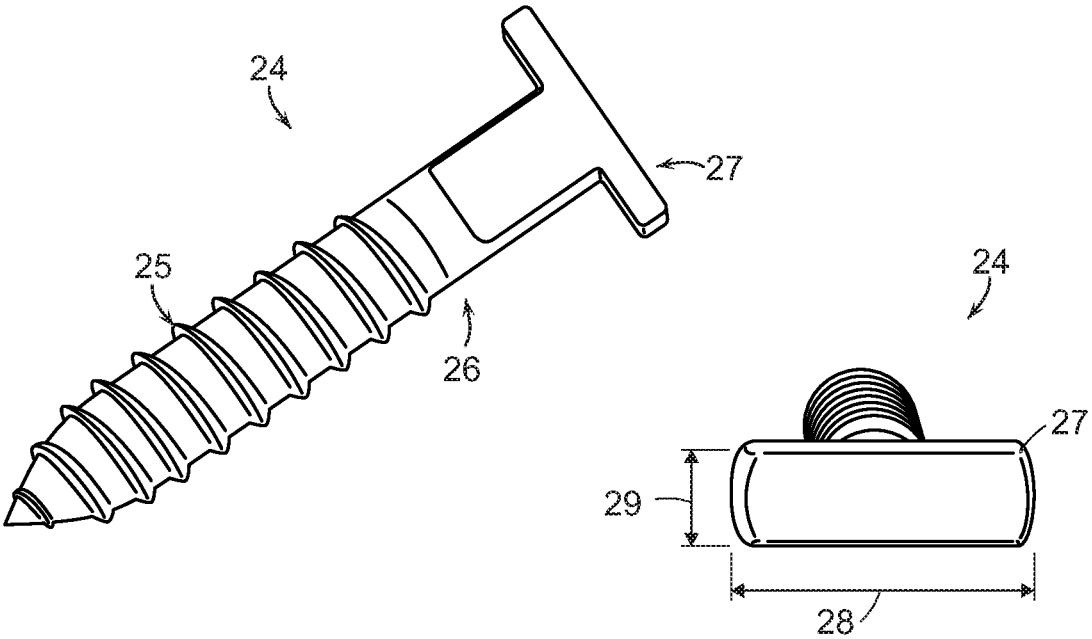
FIG. 4B shows a front view and a top view of a T-screw anchor.

Referring to the figures, FIG. 1 shows a safety screen 1 for a window which includes screen frame 2 and screen material 3. Safety screen 1 may be a safety screen in accordance with U.S. Pat. No. 9,617,784, with additional features as described herein. Safety screen 1 features holes 4 within screen frame 2. As shown in FIG. 1 and in accordance with some embodiments, holes 4 are located in parallel sides of screen frame 2 with each hole corresponding to an end of one of the parallel sides. The number of holes 4 and their locations may be adjusted as appropriate to the size of the screen as further described below. For example, in one embodiment of the invention, the holes 4 may be located in the longer parallel sides of screen frame 2. FIG. 2 shows safety screen 1 installed within window frame 5. There are a number of techniques known in the art for mounting a screen within or proximate to a window frame. For example, the window frame may include grooves to receive the screen frame. The screen may be mounted within the window frame by sliding the screen along the grooves. Window frame 5 also features anchors 7. Anchors 7 may each be individually a screw, such as a machine, flat top, or hook screw, or another fastener. Preferably, the anchor will include a head portion. FIG. 4A shows an exemplary anchor, which is machine screw 20. Screw 20 features a shaft 21 and head 23. Shaft 21 includes thread 22 thereupon. FIG. 4B shows an alternative exemplary anchor, which is flat top screw 24. Anchor 24 features head 27 along with shaft 26 and thread 25. Head 27 has an essentially rectangular shape which in conjunction with shaft 26 provides a "T" shape to anchor 24. Head 27 has a short axis 29 and a long axis 28. As shown in FIG. 2, each anchor 7 is located near a respective hole 4 in frame 2.

Figure 3:
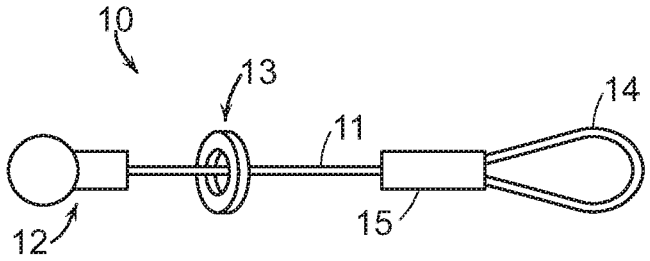
FIG. 3 is a top view of a cable system with a ball shank exterior end.

The system described herein may include holes 4 and anchor 7 as depicted in FIG. 2 along with cable system 10, such as depicted in FIG. 3. Cable system 10 features cable 11 which terminates at an exterior end with stainless steel ball shank 12 and at an interior end with loop 14, which is crimped with stainless steel sleeve 15 to hold loop 14 in place. Cable 11 and loop 14 are all a single cable looped as shown by loop 14. The cable system 10 of FIG. 3 additionally features a washer 13. Washer 13 includes an interior diameter which is less than the diameter of the ball of ball shank 12 such that washer 13 will not slide past the ball of ball shank 12 even under the application of force on washer 13.

The system may include or be provided with a safety screen, such as the safety screen described in U.S. Pat. No. 9,617,784. Safety screens are available from Lansing Housing Products, Inc. (Lansing, Iowa), including Tough Tek Metals® screens. U.S. Pat. No. 9,617,784 is incorporated herein by reference in its entirety. A safety screen in accordance with this invention is a screen that resists bending and breaking when properly installed and subjected to a 60 lbf static mid-screen load. For example, a safety screen in accordance with this invention is a screen that when properly installed and subjected to a 60 lbf static mid-screen load does not sustain any readily identifiable damage.

The cable system may be of various lengths, such as about 2 inches to about 6 inches. The length may be about 2 inches, about 2¼ inches, about 2½ inches, about 2¾ inches, about 3 inches, about 3¼ inches, about 3½ inches, about 3¾ inches, about 4 inches, about 4¼ inches, about 4½ inches, about 4¾ inches, about 5 inches, about 5¼ inches, about 5½ inches, about 5¾ inches, or about 6 inches. Preferably, the length of the cable system will include enough play to permit installation by manipulating the loop over the anchor. In embodiments, the cable system may feature about ½ inch to about 1¼ inches of play when properly installed in a safety screen frame and releasably attached to a window frame anchor.

In embodiments, four cable systems are installed to permit attachment proximate each of four corners of a rectangular window and to limit twisting of the safety screen in a way that would result in an unacceptable gap, such as a gap between a window opening and a safety screen of 4 inches or greater. For larger windows, additional cable systems may be added to ensure that no gap of 4 inches or greater may form. For example, if a 100 lb strike force noticeably bends a safety screen, additional cable systems may be provided to ensure a maximum gap between a window opening and the screen frame of less than 4 inches. Four cable attachments should suffice for a safety screen with a maximum dimension of under 40 inches. Additional cable attachments may be needed for a screen with a maximum dimension of larger than 40 inches. For example, six cables attachments, with three on each of the longer parallel sides of the window frame including one cable about 4 inches from each end and one centered along the side.

Figure 5B:
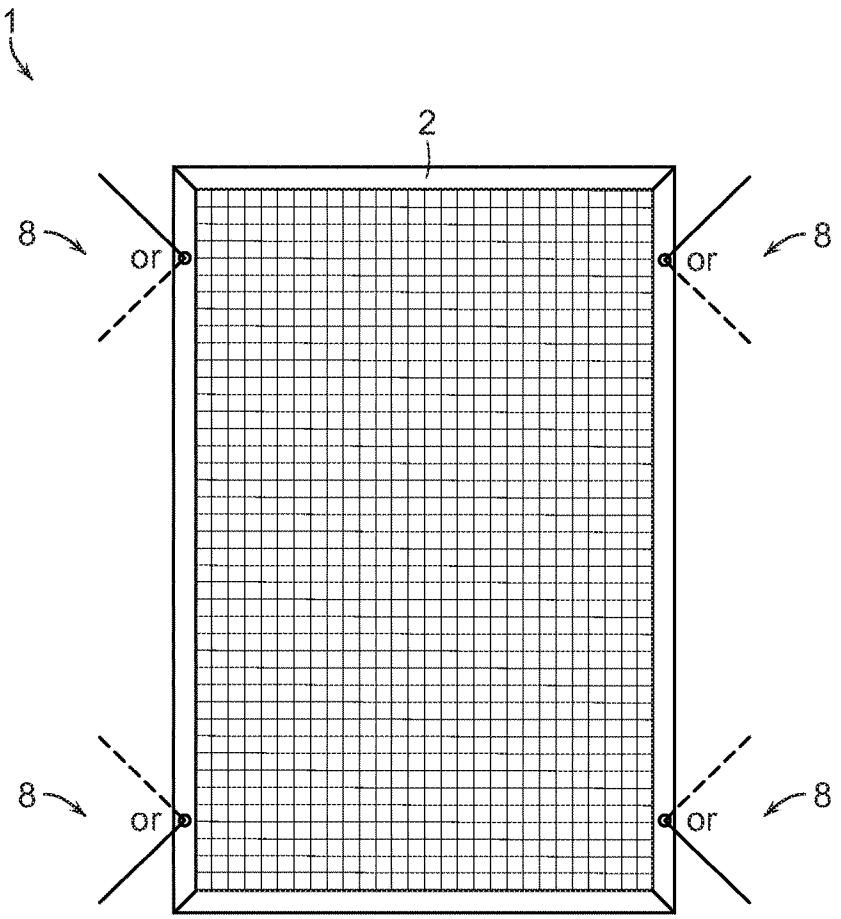
FIG. 5B shows a front view of a screen with four cable systems installed at the right and left sides of the frame.
Figure 5A:
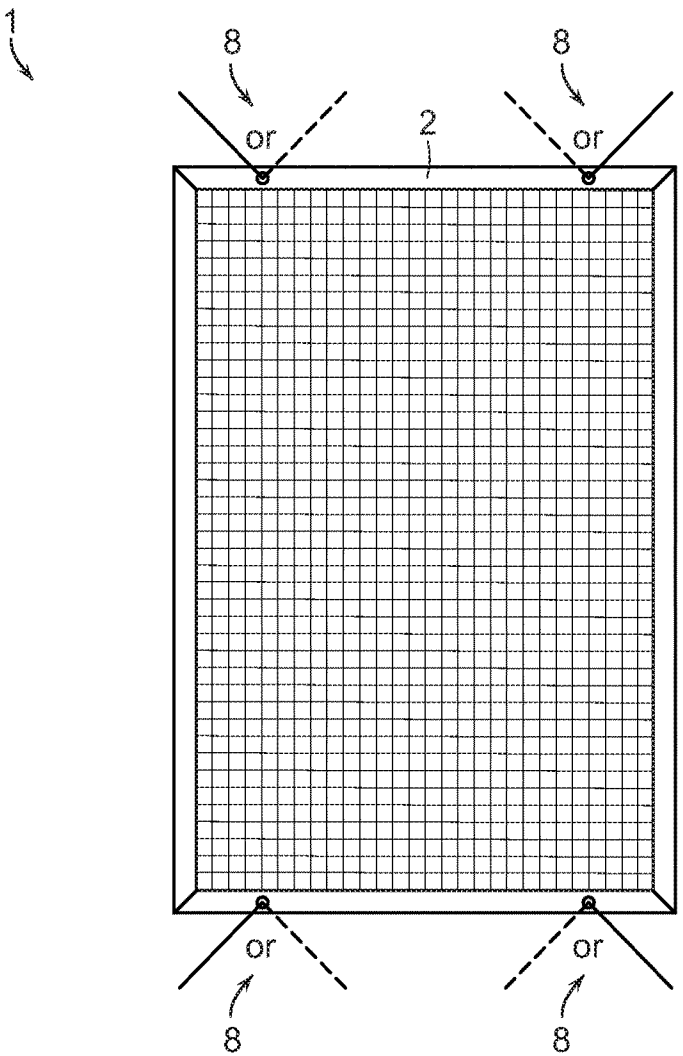
FIG. 5A shows a front view of a screen with four cable systems installed at the top and bottom of the frame.
Figure 5C:
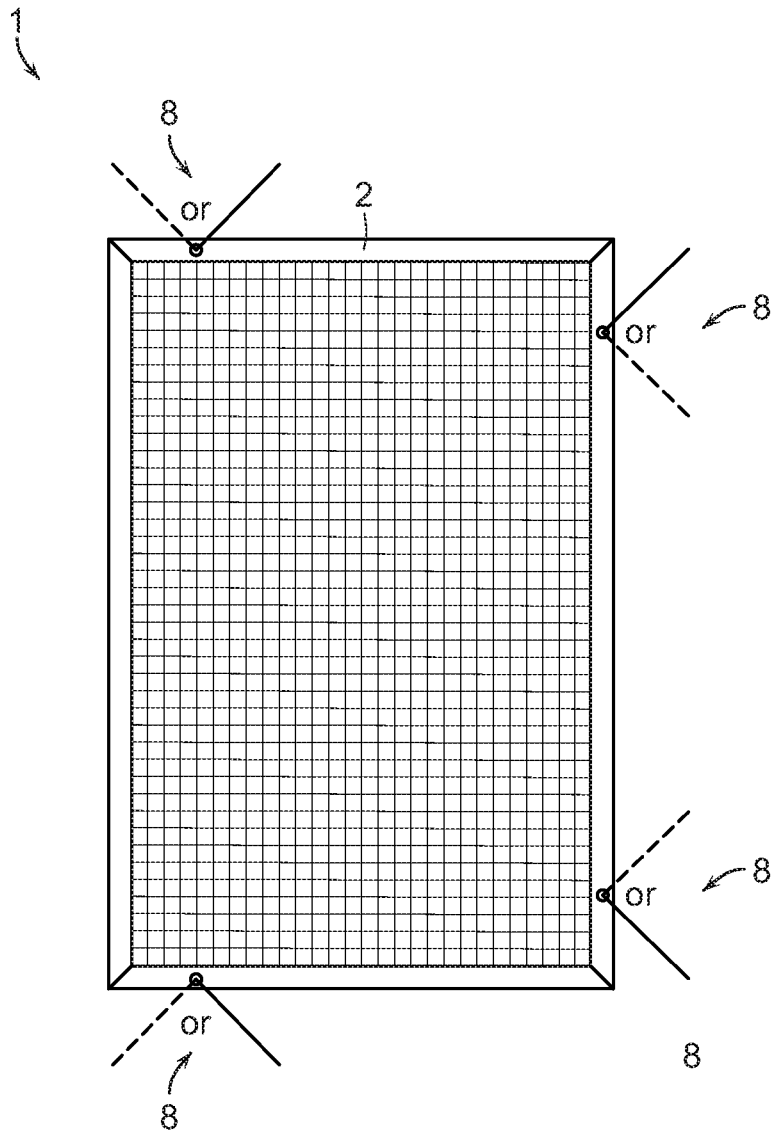
FIG. 5C shows a front view of a screen with four cable systems installed at the top, right, and bottom sides of the frame.

FIGS. 5A, 5B, and 5C each illustrate alternative exemplary installations of cable systems 8 with respect to a safety screen frame 2 and the corresponding window frame in accordance with the invention. Each of FIGS. 5A-5C illustrate alternative exemplary positions for each set of cables, one with a dashed line and one with a solid line. While some mixed configurations (e.g., two positions shown with a dashed line and two with a solid line), others may not be possible if the configuration in combination with the length of cable would permit too large a gap in the event of screen discharge. FIG. 5A depicts an example in which the cable systems are positioned on the top and bottom portions of safety screen frame 2. FIG. 5A's illustrated cable system 8 installation may be preferred with respect to a window in which the operational sash moves horizontally left to right, such as a slider window, so that the cable system does not interfere with the operational sash. FIG. 5B depicts an example in which the cable systems are positioned at the right and left portions of safety screen frame 2. FIG. 5B's illustrated cable system 8 installation may be preferred for a window with an operational sash that moves vertically up and down, such as a single-hung or double-hung window, so that the cable placement does not interfere with motion of the operable sash. FIG. 5C depicts an example in which two of the cable systems are located on the right side of frame 2 and one each are located on the top and bottom of frame 2. FIG. 5C's illustrated cable system 8 installation may be preferred for a window with an operational sash that overlaps the left side of the safety frame 2.

It may be appreciated that the invention can be used with many different window styles and configurations, including retrofit installations on existing windows. Accordingly, it is a particular advantage of the present technology that it permits flexibility in mounting the anchors and cable systems that may allow installation in a wide range of existing window and safety screen systems.

In some installations, a safety screen may be installed over an entire window including one or more window sashes. For example, a safety screen may be installed over an entire awning window or an entire casement window. It may be necessary to install a safety screen over the entirety of the interior of such a window to allow an awning window or a casement window to be opened. In other installations, a screen may be installed only over a portion of the window, such as the portion corresponding to the opening created when the window is fully opened. For example, where a single sash is operable (e.g., a single hung window, or a slider with one operable sash), the safety screen may be installed only over the window opening that may be created by the operable sash. In a window with two operable sashes (e.g., a double hung window), the screen may be installed over both sashes, covering the entire window.

The maximum cable length should be selected so that when the cables are installed in accordance with the instructions any possible gap between a window opening and a safety screen is less than 4 inches. For example, if four holes are provided in the longer sides of the safety screen frame, each the same 4 inch distance from an outer corner of the safety screen, and the corresponding anchors are installed in the longer sides of the window frame, each the same 4 inch distance from the inner corner of the window frame but offset a measurable distance to the inside of a window opening, a cable length of 4 inches will typically limit any possible gap between a window opening and a safety screen to less than 4 inches. Similarly, if four holes are provided in the longer sides of the safety screen frame, each 5 inches from an outer corner of the safety screen, and the corresponding anchors are installed on the window frame in the longer sides of the window frame, each 2 inches from the inner corner of the window frame but offset a measurable distance to the inside of a window opening, a cable length of 5.0 inches will typically limit any possible gap between a window opening and a safety screen to less than 4 inches.

A maximum gap of 4 inches between the screen frame and window frame is referred to herein as a maximum acceptable gap in view of the requirements of ASTM F2090-17. See ASTM F2090-17, ¶4.1 ("Window fall prevention screens or fall prevention window guard devices shall be constructed so as to prohibit the free passage of a 4.0-in. (102-mm) diameter rigid sphere anywhere in the window opening . . . "). However, one of ordinary skill in the art could modify systems of the present technology to achieve a larger or smaller maximum gap, if desired, for example, for compliance with other standards or to potentially achieve a greater margin of safety.

Materials that may be used for one or more of the cable, anchor, interior end, and exterior end include stainless steel, such as SAE 304 stainless steel or SAE 316 stainless steel, carbon fiber, chrome plated steel, titanium, tungsten, cast, zinc die cast, or an alloy such as one of the Inconel alloys available from the Special Metals Corporation (New Hartford, N.Y.). SAE refers to the steel grades established by SAE International.

The cable may be attached to the screen by drilling or otherwise providing an appropriately-sized hole in the screen frame, feeding an interior end of the cable through the hole from the exterior side of the screen frame, and preventing the exterior end of the cable from passing through the hole in the screen frame by sizing the exterior end to be larger than the screen frame hole. Alternatively, the cable may be face-mounted on the screen frame or crimped into the frame.

Attachment of the cable to the screen frame or of the cable to the window frame may include or consist of a button stop, a threaded rod, a threaded stop, a ball and shank, a looped end, clevises, a yoke end, a swivel snap, a T hook, eye ends, a threaded shaft, a swivel clip, a hook and ball, or a pivot T-clip. Examples of features that may be positioned at an exterior end of a cable system to attach the exterior end of the cable system to the screen frame include ball shank 12 and washer 13 shown in FIG. 3 and flat shouldered stud 32 including head portion 36, body 37, and splines 38 shown in FIG. 6.

The anchor mounted in the window frame may be a screw, such as any screw described herein. Alternatively, the anchor may be a carbon fiber attachment, a shouldered head screw, a hook screw, a J clip, a swivel clasp, a snap clip, or a magnet. The attachment of the cable to the window frame may be selected to permit a user to remove the cable system without the use of a tool and relatively easily for emergency egress or maintenance.

Figure 8:
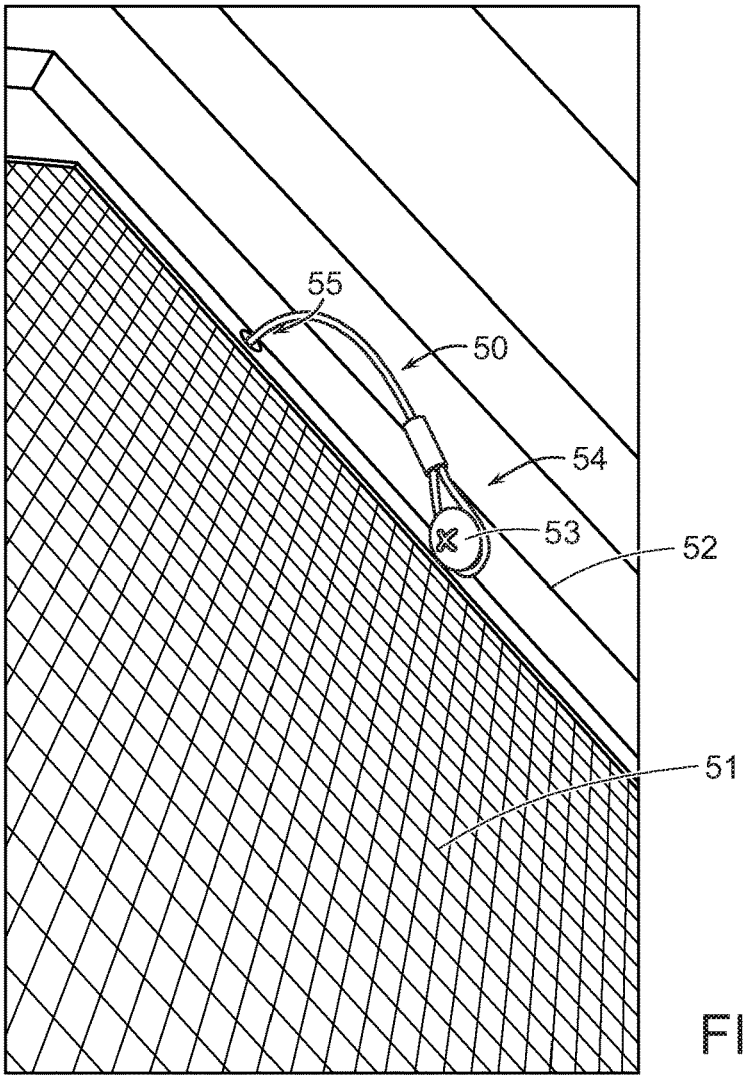
FIG. 8 shows a perspective view of an anchor and cable system attached to a screen installed in a window frame.

The anchor may be positioned in the window frame diagonally, (i.e., offset from the location of the corresponding hole in the screen frame). For example, FIG. 8 shows cable system 50 threaded through hole 55 which is offset from anchor 53 in window frame 52. For example, the anchor may be located about 2½ inches from the hole. This distance may be established to permit sufficient space for an individual's fingers to grasp and manipulate the cable, for example, as shown in FIG. 8. The anchor may also be positioned in order to allow the cable to be connected to the anchor and to reduce any interference between the anchor and the other features of the window, such as a window sash.

The cable may be selected from a number of different sizes, such as, for example, 1/32 inch, 3/64 inch, 1/16 inch, and 3/32 inch. The cable may be a coated cable. In embodiments, the cable may feature a high visibility coating, such as a red coating, to assist an individual in locating and removing the cable system for emergency egress. The cable may be a 7×7, 304 stainless steel cable. The breaking strengths associated with the foregoing are listed in Table 1. Alternatively, the cable may be a 1×19 or 7×19 cable. The numbers given for the cable correspond to the number of strands forming the cable and the number of wires in each strand, respectively. The cable may be made of galvanized carbon steel or stainless steel or of the other materials listed above. Stainless steel may be preferred to avoid deterioration of the cable in the event of exposure to water, which may occur if the coating is damaged.

A cable loop at the interior end may be secured using a crimped sleeve. The size of the crimped sleeve may be selected to accommodate the cable loop. For example, the length of the cable comprising the looped end may be from about ¾ inch to about 3½ inches. Exemplary crimped sleeve sizes are set forth in Table 1.

The screen frame holes may be formed by drilling a screen frame. Alternatively, the screen frame may be manufactured with the holes. The size of the screen frame holes may be selected to accommodate the coated cable. In embodiments where the interior end of the cable system including a loop and crimped sleeve or other fastening feature is to be threaded through the hole, the hole may be sized to accommodate the loop and crimped sleeve or other fastening feature. Exemplary hole sizes are set forth in Table 1. In embodiments, the hole to receive the cable threaded through the screen frame may be within about 8 inches of the nearest frame corner. For example, the hole may be about 1 inch, about 2 inches, about 3 inches, about 4 inches, about 5 inches, about 6 inches, or about 7 inches from the nearest corner.

TABLE 1

Cable System, Crimped Sleeve, Screen Frame Hole Diameter Combinations (7 × 7, 304 stainless steel cable)

| Coated Cable Diameter (inches) | Breaking Strength of Cable (pounds) | Crimped Sleeve Diameter (inches) | Screen Frame Hole Diameter (inches) |
|---|---|---|---|
| 1/32 | 110 | 1/8 | 5/32 |
| 3/64 | 270 | 5/32 | 3/16 |
| 1/16 | 368 | 3/16 | 7/32 |
| 3/32 | | 7/32 | 1/4 |

For example, FIGS. 6A, 6B, and 6C show a series of different perspective views of cable system 40 installed on a portion of screen 41 with screen material 42 and screen frame 43, showing cable 44, loop 45, sleeve 46, ball 47, and washer 48. Also shown is T-screw anchor 49. As shown, the long axis of the head of T-screw 49 is perpendicular of the long axis of loop 45. As described herein, this configuration provides for a two-action release where the loop must first be maneuvered parallel such that the long axis of loop 45 is parallel the long axis of the head of T-screw 49, then loop 45 must be manipulated over the head portion by releasing first one end of loop 45 and then another end. FIG. 7A shows an interior side 61 of screen 41. FIG. 7B shows an edge 62 of screen 41, though which cable 44 is threaded. FIG. 7C shows an exterior side 63 of screen 41, against which ball 47 and washer 48 are positioned.

Practice of the invention will be still more fully understood from the following examples, which are presented herein for illustration only and should not be construed as limiting the invention in any way.

Example A—3/64 Inch Cable with Flat Shouldered Stud Cable Assembly

Figure 6:
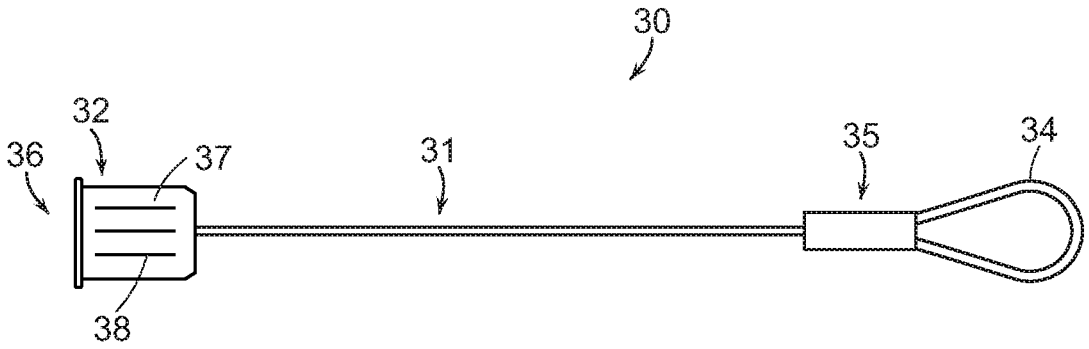
FIG. 6 shows a top view of a cable system with a flat shouldered stud exterior end.
Figure 7A:
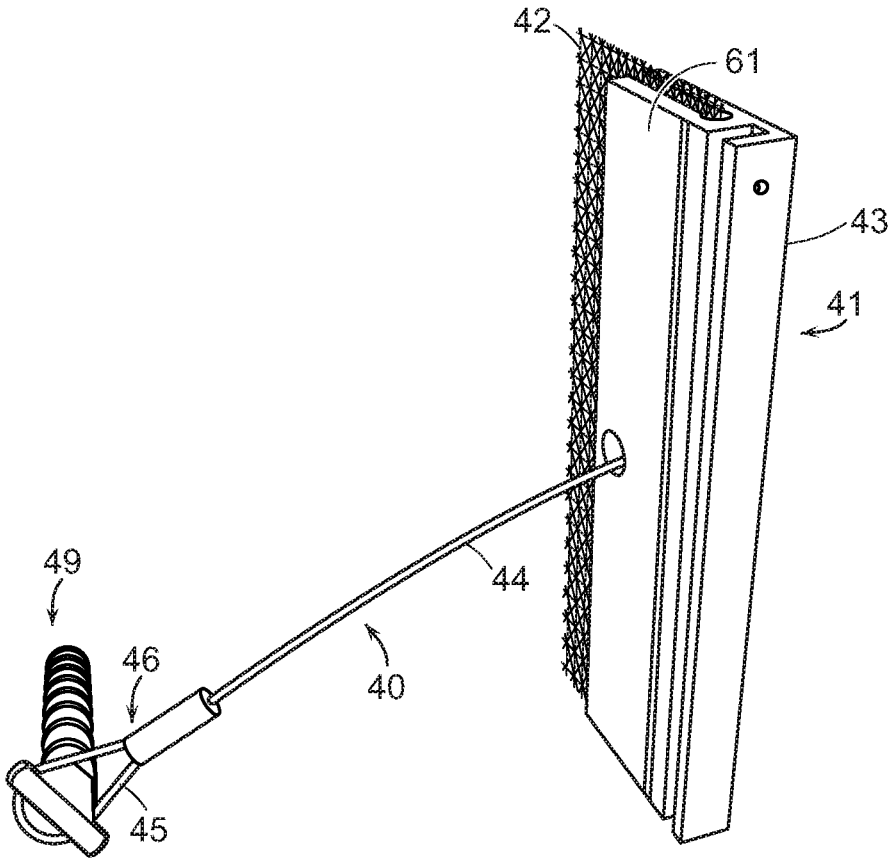
FIG. 7A shows a perspective view of an anchor, cable system, and screen portion showing the interior side of the screen portion.
Figure 7C:
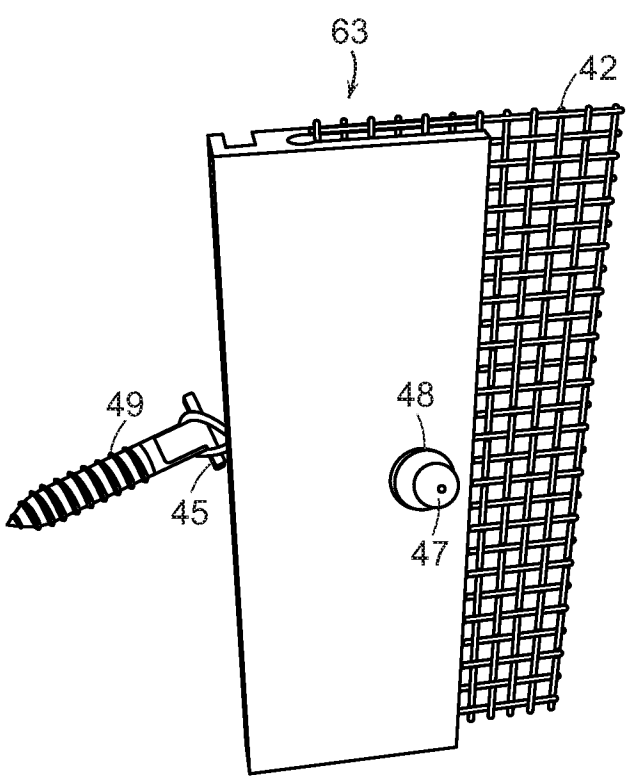
FIG. 7C shows another perspective view of an anchor, cable system, and screen portion showing the exterior side of the screen portion.
Figure 7B:
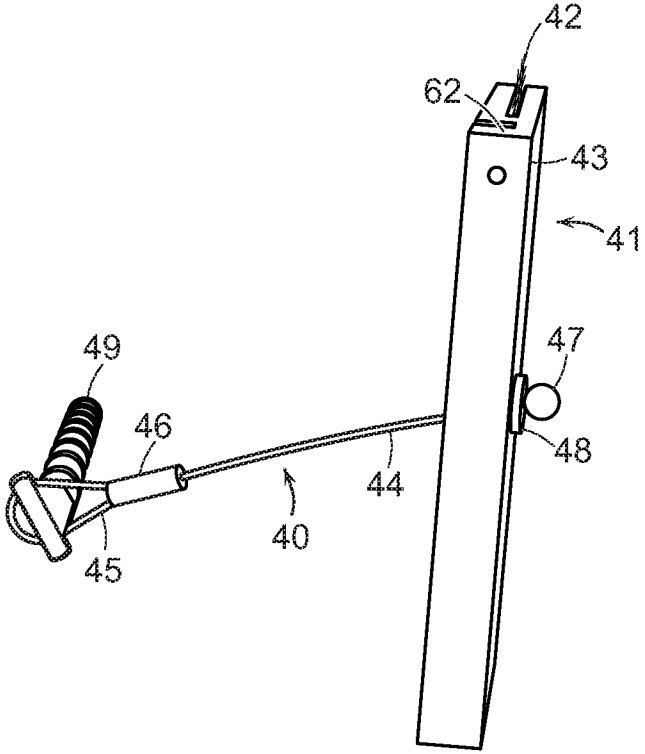
FIG. 7B shows another perspective view of an anchor, cable system, and screen portion showing an edge of the screen portion.

An exemplary prophetic system corresponds substantially to the embodiment shown in FIG. 6 as cable system 30. In Example A, cable 31 is a 3/64 inch, 7×7, SAE 304 stainless steel cable. The cable is rated to a breaking strength of 270 pounds. Cable 31 features an "Emergency Red" vinyl coating, an example of a high visibility coating. The coating provides a visual locator for cable system 30, so that a person may more easily locate and manipulate cable system 30 to remove it for emergency egress.

Cable system 30 features flat shouldered stud 32 including head portion 36, body 37, and splines 38. Loop 34 is formed from a portion of cable 31. Sleeve 35 is a stainless steel sleeve crimped to hold loop 34 in place. All components are constructed using corrosion resistant materials. Loop 34 and sleeve 35 are configured to fit just over a "T" head screw selected for use as an anchor, such as anchor 24 of FIG. 4B. Cable system 30 has an overall length of 3⅝ inches. The screen frame holes (e.g., similar to holes 4 in FIG. 1), are 3/16 inch diameter holes drilled in the screen frame. This size is sufficient to allow the stainless-steel sleeve and loop to fit through the hole.

Flat shouldered stud 32 is configured to be seated into a hole drilled in the screen frame such that head 36 is seated against the exterior side of the screen frame and body 32 is positioned within the hole. In Example A, the screen frame hole is 3/16 inch diameter, the depth of body 32 is 7/32 inch, the width of body 32 is 5/32 inch, the width of head 36 is 5/16, the depth of head 36 is 1/16 inch. Splines 36 are configured to assist in seating flat shouldered stud 32 in position in the screen frame hole such that flat shouldered stud 32 does not slide out from the screen frame hole after installation.

Providing flat shouldered stud 32 or, in other embodiments, a different style exterior end of a loop cable system, substantially within the hole provides additional advantages. Specifically, where the hole is filled at least at one end, insects will be unable to pass through the screen frame hole. Additionally, where the cable system is not exposed on the exterior side of the window screen, an intruder would be unable to access and cut the cable. This advantage is further enhanced by the relatively flat profile of head 36, which reduces the ability to grip flat shouldered stud 32 from the exterior side when it is installed. On the other hand, flat shouldered stud 32 may be removed relatively more easily by applying force from the interior side to disassemble the system.

Cable system 30 is configured for use with a zinc-plated zinc T-head screw as an anchor, substantially similar to anchor 24 of FIG. 4B. The overall length of the T-head screws is 1⅝ inches and the diameters of thread 25 and shaft 26 are ¼ inch. The long axis 28 of head 27 measures ½ inch, while the short axis 29 is about ¼ inch. In Example A, the anchor is positioned in the window frame such that the long axis of the head is parallel the vertical axis of the window. If the screen dislodges and the cable system is pulled taut, the loop will turn, aligning the long axis of the loop perpendicular to the vertical axis of the window. As a result, the long axis of the loop will be perpendicular to the long axis of the anchor head and the short axis of the loop will be better positioned to catch against the long axis of the anchor head, holding the loop in place on the anchor. Vertical axis refers to the axis that is oriented vertically when the window is installed.

In Example A, the loop and the anchor are sized and configured to provide an additional safety feature. When loop 34 is positioned on anchor 24 over head 27, in order to remove loop 34, a user positions loop 34 such that the long axis of the loop is parallel the long axis of the anchor and then applies some force (e.g., about 2 to 3 pounds) parallel to the "T"-head in a downwards motion to loop 34 to clear the edge of the T leg before removing (e.g., the user pushes the upper end of loop 34 down while pulling the lower end (near sleeve 30) over one end of head 37 then moves the upper end of loop 34 up and over the opposite end of head 37). This configuration reduces the possibility of loop 34 becoming loose unintentionally from head 27, or of a child removing loop 34, while still permitting relatively fast intentional removal by a user, for example for emergency egress. Moreover, the configuration provides a release mechanism requiring two distinct actions to operate. F2090-17 includes a standard providing that certain window fall prevention devices feature two distinct actions to operate. See F2090-17 at ¶4.5.3 ("To protect against inadvertent operation by a young child, the emergency escape (egress) release mechanism(s) shall require two distinct actions to operate."). The embodiment described in Example A therefore meets this standard as described above.

Example B— 3/64 Inch Cable with Stainless Steel Ball Shank

An exemplary working system has been prepared corresponding substantially to the embodiment depicted in FIG. 3. In Example B, cable 11 was a 3/64 inch 7×7, SAE 304 stainless steel cable. Ball shank 12 was a 3/64 inch stainless steel ball shank crimped on one end. Sleeve 15 was a stainless steel sleeve. All components used in Example B's cable system 10 are corrosion resistant. Cable 11 was a 3/64 inch, 7×7, SAE 304 stainless steel cable. The cable is rated to a breaking strength of 270 pounds. The cable was tested to and has a breaking strength of 270 pounds. The entire assembly, that is the assembly corresponding to cable system 10, was tested and determined to have a breaking strength of 255 pounds. The total length of the cable with the components as described was 3⅝ inch. Cable 11 and an "Emergency Red" vinyl coating on it. The coating provides a visual locater for emergency egress.

The system was installed in a test screen and window frame by drilling 3/16 inch holes in the screen frame. Four holes were drilled in the window frame portions corresponding to the vertical frame portions when the screen is installed, with one hole each at the top and bottom on either side. The holes were each 4 inches from the respective corners. Anchors were mounted in the window frame, substantially as shown in FIG. 2. FIG. 8 shows a portion of the test screen and window frame with one of the four cable systems. FIG. 8 shows the cable system 50, threaded through test screen 51 at hole 55, which was installed in test window frame 52 featuring anchor 53. Anchor 53 was a round-headed screw. Loop 54 of cable system 50 was installed over anchor 53 in test window frame 52.

To prepare Example B, the loop was introduced to the exterior side of the hole in the screen frame and pushed through to the interior side. The loop was then positioned over the anchor in the window frame as the screen was positioned against the window frame. Accordingly, the ball of the ball shank, a portion of the cable, and the washed remained on the exterior side of the screen frame. The loop was placed over the anchor head. Four cable systems were installed according to the configuration shown by the solid lines in FIG. 5C.

The system was tested according to ASTM Standard F2090-17. Specifically, the screen was positioned on the window frame and the system was attached as described. An impactor with a 100 pound weight suspended on a cable was positioned at 2 inches from the screen at the center of the screen and then was lifted back such that the impactor reached a height of 12 inches above its initial position. The impactor was released and allowed to impact the screen. It was observed that the screen pulled away from the window frame but remained attached by each of the four cable systems. It was further observed that the screen would not permit passage of a 4 inch diameter rigid sphere through or around the screen or window opening. Accordingly, it was determined that the system passed the 100 pound foot test.

Figure 9:
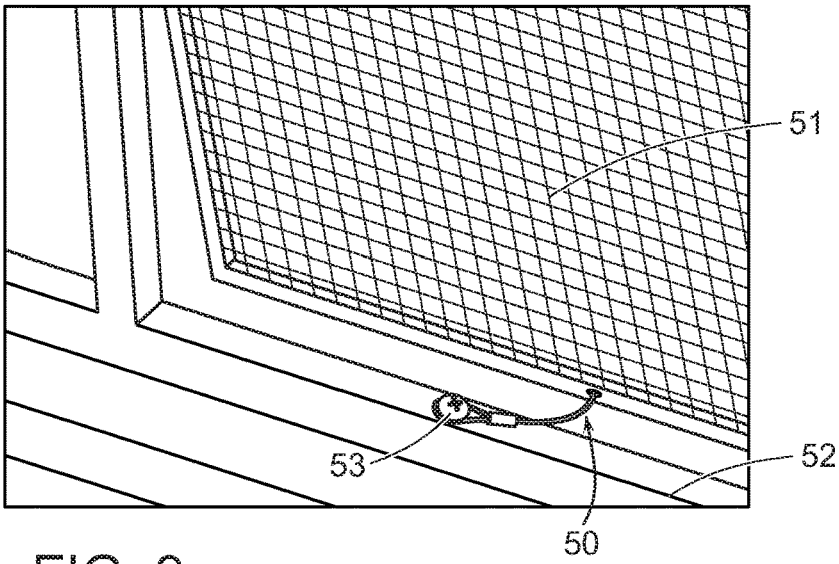
FIG. 9 shows a perspective view of an anchor and cable system attached to a screen installed that has been discharged from a window frame.

FIG. 9 shows one of the four cable systems of Example B after the test, including cable system 50 and test screen 51, with force applied manually to test screen 51 to show that test screen 51 has come loose from test window frame 52, but is still attached by cable system 50. Accordingly, the gap between test screen 51 and window frame 52 is limited to not more than 4 inches by the cable system 50.

Example C— Determining Maximum Cable Length and Installation Offset for Cable Assembly The relationship between maximum cable length and offset between the screen hole and window frame anchor required to allow a maximum gap between the screen frame and the window frame of less than 4 inches is easily calculated from known trigonometric relationships. A right triangle is known to have the relationship that the square of the longest side is equal to the sum of the squares of the two shorter sides of the right triangle. This is sometimes describes as $a^2+b^2=c^2$, where a and b are the lengths of the two sides adjacent to the right angle and c is the length of the triangle side opposite the right angle. The side of the right triangle opposite with right angle will be the cable length, C. One side of the right triangle is a maximum gap between the window anchor and safety screen frame hole, B, that should be less than 4 inches. The other side of the right triangle is the offset between the window frame anchor and the safety screen frame hole, A.

The required cable length C for a given offset A to achieve a maximum gap B of less than 4 inches can be calculated from the relationship: The gap B is the square root of the difference between the square of the cable length C and the square of the offset A, and the maximum gap must be less than 4 inches. Similarly, the required offset A for a given cable length C to achieve a maximum opening distance B of less than 4 inches can be calculated from the same relationship. Where the offset A is very small, the cable length C should be less than 4 inches to allow for offset error. Applying the 3/4/5 special case of the right triangle relationship allows one easy estimate: where the offset A between the window anchor and the screen hole is greater than 3 inches, such as when the anchor is located within an inch of the corner of a window frame and the screen hole is at least four inches from the corresponding corner of safety screen frame, the cable length C could be up to 5 inches and allow a maximum gap between the anchor and the screen frame hole of less than 4 inches. Other possible cable length C and offset A combinations that allow a maximum gap B of less than 4 inches are readily calculated from the relationship assuming a cable attachment at each of four corners in accordance with FIGS. 5A-5C.

What is claimed is:

1. A safety cable system for improving fall prevention through an opening of a window, the safety cable system comprising:

at least four anchors for a window frame;

first instructions for installing each of the at least four anchors in the window frame;

at least four safety cables, each safety cable comprising an exterior end configured to secure to an attachment point of a safety screen frame and an interior end configured to releasably attach to an anchor installed in a window frame, wherein each releasable attachment is designed to be released without the use of any tools; and second instructions for securing the exterior end of at least one of the at least four safety cables to an attachment point of a safety screen frame and releasably attaching the interior end of the at least one safety cable to the anchor installed in a window frame, wherein the length of the at least four safety cables allows a maximum gap between the safety screen frame and the window opening that is less than four inches when the at least four anchors are installed in accordance with the first instructions, the at least four safety cables are secured and attached in accordance with the second instructions, and the safety screen frame is pushed away from the window opening.

2. The safety cable system of claim 1 further comprising a safety screen comprising a frame with attachment points for each of the at least four safety cables.

3. The safety cable system of claim 1 further comprising instructions for creating at least four attachment points in a safety screen frame.

4. The safety cable system of claim 3 wherein the instructions for creating at least four attachment points in a safety screen frame comprise instructions for drilling holes at appropriate locations in the safety screen frame.

5. The safety cable system of claim 1, wherein the distance from the exterior end of the safety cable when attached to a first attachment point to the interior end of the safety cable when attached to a first anchor is less than 4 inches.

6. The safety cable system of claim 1, wherein a first anchor comprises a head and a shaft, and the interior end of the safety cable comprises a loop configured to fit over the head and seat on the shaft.

7. The safety cable system of claim 6 wherein the first anchor is a T-shaped screw and the head includes a long axis perpendicular to a vertical axis of the window.

8. The safety cable system of claim 7, wherein the first anchor and loop are configured such that the loop must be positioned parallel the long axis of the head and pressure must be applied to the loop to release the loop from the first anchor.

9. The safety cable system of claim 2, wherein the safety screen is a safety screen configured to resist bending or breaking under force.

10. A safety cable system for use with a safety screen frame having a hole with a hole diameter, the safety cable system comprising:

an anchor comprising an anchor head and a threaded shaft configured to be installed in a window frame, wherein the anchor is a T-shaped screw and the anchor head includes a long axis perpendicular to a vertical axis of the window frame; and a safety cable comprising:

a cable having a cable diameter less than the hole diameter;

an exterior end of the cable comprising a flat shouldered stud or a ball shank and having an exterior end diameter;

the exterior end diameter being greater than the hole diameter; and an interior end of the cable comprising a loop and having an interior end diameter less than the hole diameter, the loop configured to be placed over the anchor head.

11. The safety cable system of claim 10, wherein the cable has a high visibility coating.

12. The safety cable and anchor system of claim 10, wherein the anchor and loop are configured such that the loop must be positioned parallel the long axis of the head and pressure must be applied to the loop to release the loop from the anchor.

13. A safety cable system for improving fall prevention through an opening of a window, the safety cable system comprising:

at least four anchors for a window frame;

a safety screen sized to fit the window frame and comprising a screen frame with a plurality of attachment points;

at least four safety cables, each safety cable comprising an exterior end configured to secure to one of the attachment points and an interior end configured to releasably attach to one of the anchors when the anchor is installed in the window frame; and wherein the length of the at least four safety cables allows a maximum gap between the screen frame and the window opening that is less than four inches when the four anchors are installed in the window frame, the at least four safety cables are secured and attached to the anchors and attachment points, and the screen frame is pushed away from the window opening.

14. The safety cable system of claim 13, wherein each anchor comprises a head and a shaft, and the interior end of each safety cable comprises a loop configured to fit over the head and seat on the shaft.

15. The safety cable system of claim 14, wherein each anchor is a T-shaped screw and the head includes a long axis perpendicular to a vertical axis of the window.

16. The safety cable system of claim 14, wherein each anchor and loop are configured such that the loop must be positioned parallel the long axis of the head and pressure must be applied to the loop to release the loop from the anchor.

17. The safety cable system of claim 13, wherein the safety screen is a safety screen configured to resist bending or breaking under force.

* * * * *